US007021564B2

(12) United States Patent
Raimann

(10) Patent No.: US 7,021,564 B2
(45) Date of Patent: Apr. 4, 2006

(54) FUEL INJECTION VALVE

(75) Inventor: Juergen Raimann, Weil der Stadt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/415,544

(22) PCT Filed: Jun. 14, 2002

(86) PCT No.: PCT/DE02/02174

§ 371 (c)(1),
(2), (4) Date: Sep. 8, 2003

(87) PCT Pub. No.: WO03/027488

PCT Pub. Date: Apr. 3, 2003

(65) Prior Publication Data

US 2004/0026536 A1 Feb. 12, 2004

(30) Foreign Application Priority Data

Aug. 29, 2001 (DE) ..... 101 42 301

(51) Int. Cl.
*F02M 59/00* (2006.01)
*B05B 1/28* (2006.01)

(52) U.S. Cl. ..... 239/533.2; 239/585.1; 239/104; 239/288; 239/288.3; 239/288.5

(58) Field of Classification Search ..... 239/533.2–533.15, 585.1, 900, 103, 104, 239/288, 288.3, 288.5
See application file for complete search history.

(56) References Cited

U.S. PATENT DOCUMENTS

| | | | | |
|---|---|---|---|---|
| 1,425,329 A | | 8/1922 | Mellblom | |
| 4,519,547 A | * | 5/1985 | Kubach et al. | 239/585.5 |
| 5,161,743 A | * | 11/1992 | Takeda et al. | 239/533.11 |
| 5,476,226 A | * | 12/1995 | Tomiita et al. | 239/585.5 |

FOREIGN PATENT DOCUMENTS

| | | |
|---|---|---|
| DE | 29 05 396 | 8/1980 |
| DE | 29 39 280 | 4/1981 |
| DE | 34 24 891 | 1/1985 |
| DE | 39 28 912 | 4/1990 |
| DE | 38 41 324 | 6/1990 |
| DE | 44 42 355 | 5/1996 |
| DE | 36 23 223 | 2/1998 |
| DE | 198 04 463 | 8/1999 |
| JP | 57 152 458 | 9/1982 |
| JP | 58 90365 | 5/1983 |

* cited by examiner

*Primary Examiner*—David A. Scherbel
*Assistant Examiner*—Seth Barney
(74) *Attorney, Agent, or Firm*—Kenyon & Kenyon

(57) ABSTRACT

A fuel injector (1) for direct injection of fuel into the combustion chamber of internal combustion engines having an actuator (10), a valve needle (3) operable by the actuator (10) for actuation of a valve closure member (4) which, together with a valve seat face (6) on a valve seat member (5), forms a sealing seat, and at least one spray discharge orifice (7), which is formed downstream from the valve seat (6). A flame protection cone (34) is provided on a downstream end (35) of the fuel injector (1).

9 Claims, 2 Drawing Sheets

FUEL INJECTION VALVE

FIELD OF THE INVENTION

The present invention relates to a fuel injector.

BACKGROUND INFORMATION

German Published Patent Application No. 198 04 463 describes a fuel injection system for an internal combustion engine having spark ignition of a compressed fuel-air mixture, comprising a fuel injector which injects fuel into a combustion chamber formed by a piston/cylinder construction, and equipped with a spark plug projecting into the combustion chamber. The fuel injector is equipped with at least one row of injection holes distributed around the circumference of the fuel injector. Through controlled injection of fuel through the injection holes, a jet-guided combustion is implemented by forming a cloud of the mixture using at least one jet.

One disadvantage of the fuel injector known from the publication cited above is in particular the coking of the spray discharge orifices, which therefore become clogged and reduce the flow through the fuel injector to an unacceptable extent. This results in malfunctioning of the internal combustion engine.

SUMMARY OF THE INVENTION

The fuel injector according to the present invention has the advantage over the related art that a flame protection cone situated downstream from the spray discharge orifices of the fuel injector greatly reduces the temperature of the flame front of the cloud of burning mixture, in the area of the spray discharge orifices to such a great extent that no combustion residues are deposited in the area of the spray discharge orifices, so that clogging of the spray discharge orifices due to coking residues is prevented.

The flame protection cone is advantageously provided on the spray discharge end of the fuel injector, e.g., on the valve seat body.

It is advantageous in particular that the flame protection cone is designed as a cone or a truncated cone, as a multipart cone having different angles of inclination or as a truncated cone having a sphere placed on top of it, thus permitting simple and inexpensive manufacturing while making it possible to take into account any injection systems having any number and arrangement of spray discharge orifices.

In addition, it is readily possible to implement an oblique injection at any injection angle due to the slope of the flame protection cone.

DETAILED DESCRIPTION

Figure 1:
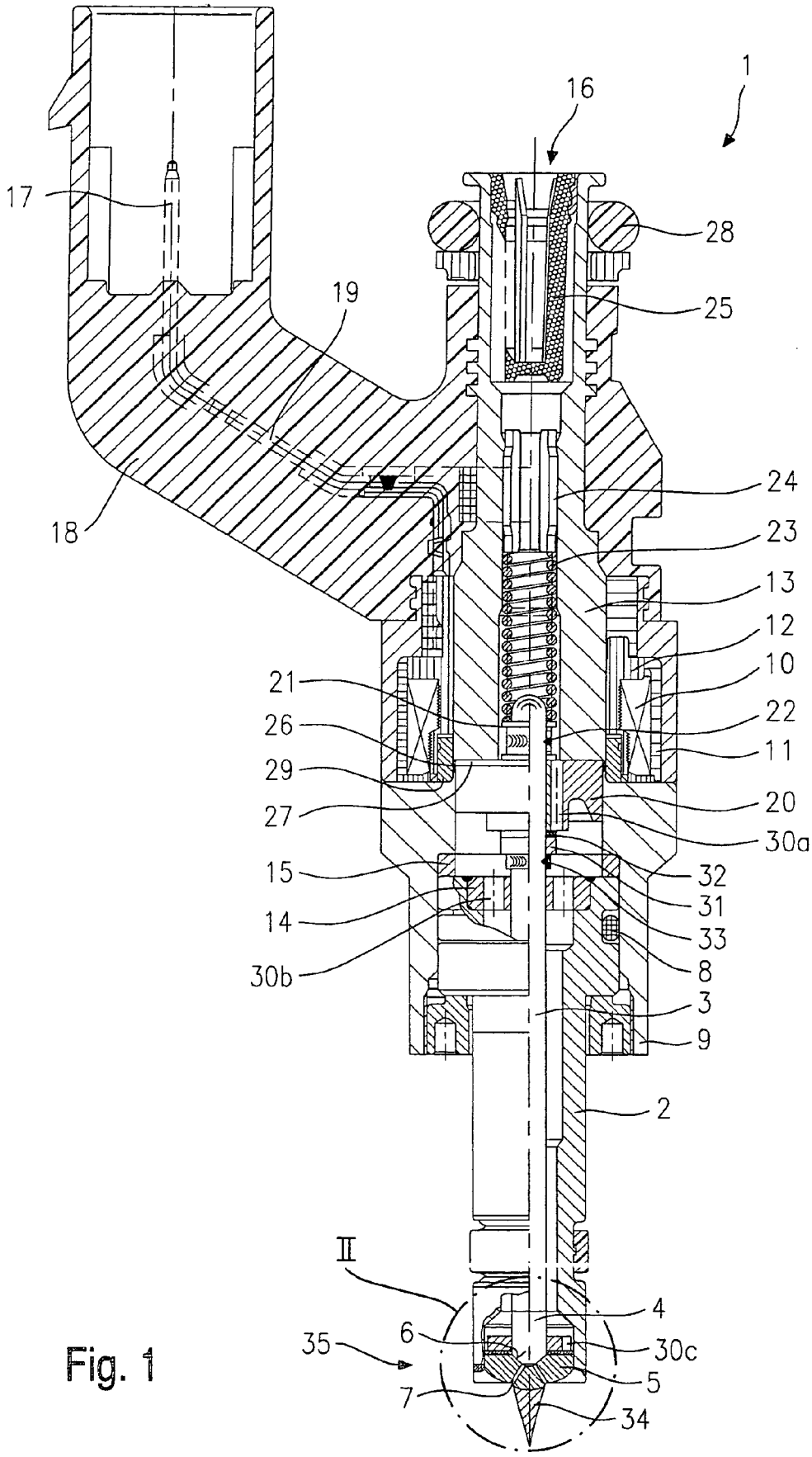
FIG. 1 shows a schematic section through a first exemplary embodiment of a fuel injector according to the present invention in an overall view.

In a schematic sectional diagram, FIG. 1 shows one exemplary embodiment of a fuel injector 1 according to the present invention. Fuel injector 1 is designed in the form of a fuel injector 1 for fuel injection systems of internal combustion engines having spark ignition of a compressed fuel-air mixture. Fuel injector 1 is suitable for direct injection of fuel into a combustion chamber (not shown) of an internal combustion engine.

Fuel injector 1 is composed of a nozzle body 2 in which a valve needle 3 is situated. Valve needle 3 is mechanically linked via a weld seam, for example, to a valve closing body 4 which cooperates with a valve closure member 6 situated on a valve seat member 5 to form a sealing seat. In the exemplary embodiment, fuel injector 1 is an inwardly opening fuel injector 1 having a plurality of spray discharge orifices 7 on at least one circle concentric with the axis of valve seat member 5.

Nozzle body 2 is sealed by a gasket 8 with respect to external pole 9 of a solenoid 10 which functions as an actuator for valve needle 3. Solenoid 10 is encapsulated in a coil housing 11 and is wound onto a field spool 12 which contacts an internal pole 13 of solenoid 10. Internal pole 13 and external pole 9 are separated by a gap 26 and are supported on a connecting part 29. Solenoid 10 is energized by an electric current suppliable via an electric plug-in contact 17 over a line 19. Plug-in contact 17 is surrounded by plastic sheathing 18, which may be integrally extruded on internal pole 13.

Valve needle 3 is guided in a valve needle guide 14, which is designed in the form of a disk. An adjusting disk 15 paired with it is used to adjust the lift. An armature 20 situated on the other side of adjusting disk 15 is connected in a friction-locked manner via a first flange 21 to valve needle 3, which is connected to first flange 21 by a weld 22. A restoring spring 23 supported on first flange 21 is brought to a prestress by a sleeve 24 in the present design of fuel injector 1.

A second flange 31 situated downstream from armature 20 functions as a lower armature stop. It is connected to valve needle 3 in a friction-locked manner via a weld 33. An elastic spacer ring 32 for damping armature impacts as fuel injector 1 is closed is situated between armature 20 and second flange 31.

Fuel channels 30*a* through 30*c* run in valve needle guide 14, in armature 20 and on valve seat member 5. Fuel is supplied through a central fuel feed 16 and filtered through a filter element 25. Fuel injector 1 is sealed by a gasket 28 against a distributor line (not shown in detail).

According to the present invention, fuel injector 1 has a flame protection cone 34 on valve seat member 5, the cone being mounted within the at least one circle of spray discharge orifices 7. Due to its placement downstream from spray discharged orifices 7 flame protection cone 34 decreases the coking tendency and thus prevents malfunctioning of fuel injector 1 by plugging spray discharge orifices 7 and an unpermissible reduction in fuel flow. A spray discharge end 35 of fuel injector 1 implementing the measures according to the present invention is shown in detail in FIGS. 2 and 3A.

In the resting state of fuel injector 1, first flange 21 on valve needle 3 is acted upon by restoring spring 23 against a direction of lift, so that valve closure member 4 is kept in sealing contact with valve seat 6. Armature 20 rests on spacer ring 32 which is supported on second flange 31. When solenoid 10 is energized, it builds up a magnetic field which moves armature 20 in the direction of lift against the spring force of restoring spring 23. In doing so, armature 20 also entrains first flange 21, which is welded to valve needle 3, and thus also entrains valve needle 3 in the direction of lift. Valve closure member 4, which is mechanically connected to valve needle 3, lifts up from valve seat face 6, so that fuel is spray discharged at spray discharge orifices 7.

When the coil current is turned off and after the magnetic field has declined sufficiently, armature 20 drops away from internal pole 13 due to the pressure of restoring spring 23 on first flange 21, so that valve needle 3 moves against the direction of lifting. Therefore, valve closure member 4 is set down on valve seat face 6 and fuel injector 1 is closed. Armature 20 is set down on the armature stop formed by second flange 31.

Figure 2:
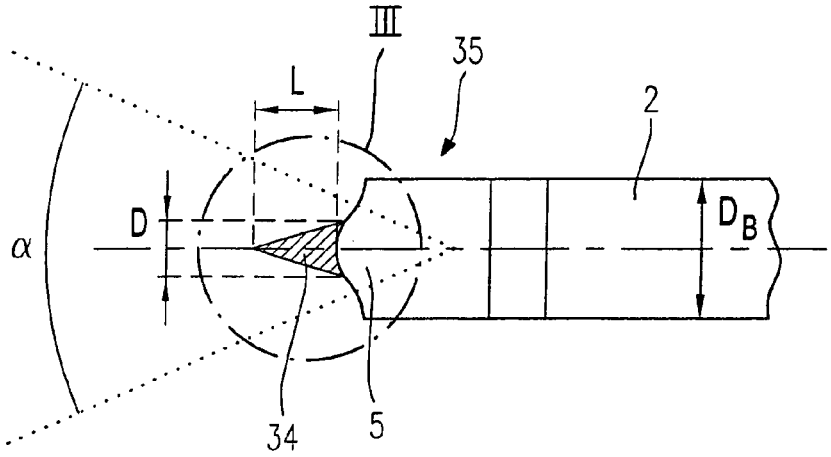
FIG. 2 shows an enlarged schematic view of the spray discharge side part of the fuel injector shown in FIG. 1 in area II in FIG. 1.

FIG. 2 shows an enlarged schematic view of spray discharge end 35 of fuel injector 1 designed according to the present invention as shown in FIG. 1 in area II in FIG. 1.

As already mentioned in the description of FIG. 1, fuel injector 1 has a flame protection cone 34 which is situated in the area of spray discharge orifices 7, e.g., on valve seat member 5, to lower the flame temperature. Flame protection cone 34 is designed in the form of a pointed cone and may either be designed in one piece with valve seat member 5 or attached to it in a suitable manner, e.g., by soldering, welding or gluing.

Axial length L and diameter D of flame protection cone 34 depend on cone vertex angle $\alpha$ of the cloud of mixture injected into the combustion chamber and should be of such dimensions that flame protection cone 34 is not wetted by the cloud of mixture.

It is possible to minimize coking of spray discharge orifices 7 through the placement of flame protection cone 34 downstream from spray discharge orifices 7. Since the diameter of spray discharge orifices 7 is typically approx. 100 μm, there is a relatively high risk of spray discharge orifices 7 becoming clogged due to coking over a period of time, thus restricting the flow rate to an inadmissible extent. This is due to the high temperatures as the cloud of mixture injected into the combustion chamber is ignited in particular, because constituents of the fuel are therefore deposited at the tip of fuel injector 1. Due to the placement of flame protection cone 34, it is possible to lower the surface temperature in the outlet area of spray discharge orifices 7 so much that spray discharge orifices 7 do not become clogged by coking residues. Flame protection cone 34 prevents in particular the flame front from widening in the area of spray discharge orifices 7.

Figure 3A:
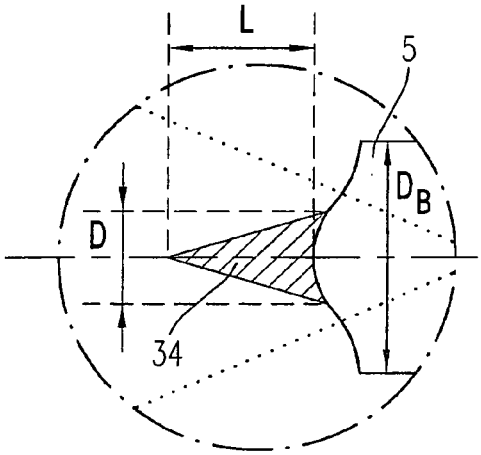
FIGS. 3A–C show exemplary embodiments of a flame protection cone embodied according to the present invention, each being mounted on a spray discharge end of the fuel injector.
Figure 3B:
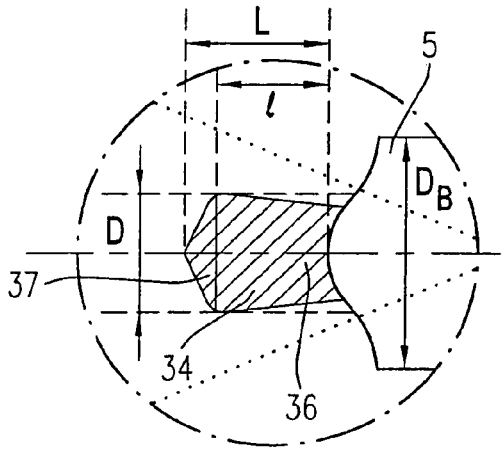
Figure 3C:
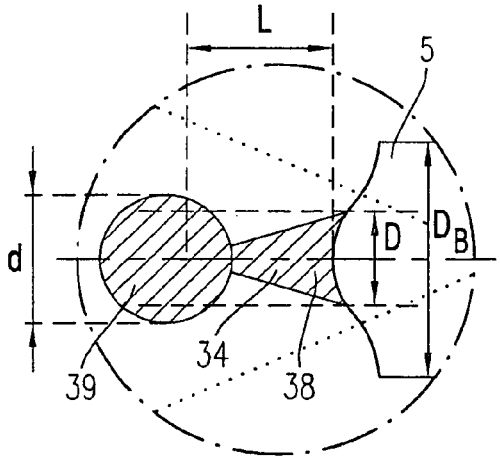

FIGS. 3A through 3C show the detail (labeled as III in FIG. 2) of fuel injector 1 designed according to the present invention and having different embodiments of flame protection cone 34 according to the present invention.

FIG. 3A shows the simple conical shape mentioned above with respect to FIG. 2. Length L of flame protection cone 34 and its diameter D at the base depend on the shape and cone vertex angle $\alpha$ of the injected cloud of mixture. Axial length L typically amounts to as much as three times diameter $D_B$ of spray discharge end 35 of fuel injector 1, while diameter D amounts to at most half of diameter $D_B$ of spray discharge end 35 of fuel injector 1.

FIG. 3B shows another possible shape of flame protection cone 34, where a first area 36 facing valve seat member 5 is designed as a truncated cone, diameter D increasing from the base in the direction of spray discharge. This is followed by a second area 37, which is designed as a truncated cone. Diameter D of first area 36 amounts to up to half of diameter $D_B$ of spray discharge end 35 of fuel injector 1 at the base and may increase up to one and one-half times diameter $D_B$ of downstream end 35 of fuel injector 1 at the shoulder of second area 37. Axial length L of flame protection cone 34 may amount to up to four times diameter $D_B$ of fuel injector 1 in the area of valve seat member 5, up to one fourth of which second area 37.

FIG. 3C shows a third embodiment of flame protection cone 34 according to the present invention, the shape of a truncated cone 38 having a sphere 39 placed on top being selected here. As in the first exemplary embodiment, axial length L of truncated cone 38 may amount to up to three times diameter $D_B$ of fuel injector 1 in the area of valve seat member 5, while sphere 39 may have a diameter d which corresponds to diameter $D_B$ of fuel injector 1 in the area of valve closure member 5.

Figure 4:
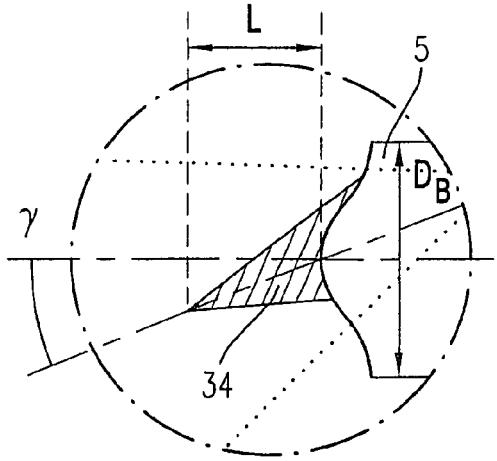
FIG. 4 shows an exemplary embodiment of a flame protection cone embodied according to the present invention on a fuel injector suitable for oblique injection.

Similarly to the embodiments illustrated in FIGS. 3A through 3C, where angle $\gamma$ at which the cloud of mixture is injected into the combustion chamber amounts to approx. 0°, similar shapes are mounted on valve seat member 5, so that oblique injection at any angle $\gamma$ different from 0° is possible. This is shown in FIG. 4 similarly to the exemplary embodiment illustrated in FIG. 3A on the basis of pointed conical flame protection cone 34.

The present invention is not limited to the exemplary embodiments presented here and it may be used with any forms of flame protection cones 34, which are attachable in any desired manner to the spray discharge end of fuel injector 1 and with any designs of fuel injectors 1.

What is claimed is:

1. A fuel injector for direct injection of a fuel into a combustion chamber of an internal combustion engine, comprising:

an actuator;

a valve closure member;

a valve seat member;

a valve seat face arranged on the valve seat member;

a valve needle operable by the actuator and for actuation of the valve closure member, the valve closure member, together with the valve seat face, forming a sealing seat;

a structure including at least one spray discharge orifice formed downstream from the valve seat; and a flame protection cone fixed on a downstream end of the valve seat member.

2. The fuel injector as recited in claim 1, wherein:

the flame protection cone is produced on the valve seat member.

3. The fuel injector as recited in claim 1, wherein:

the flame protection cone is a pointed cone.

4. The fuel injector as recited in claim 3, wherein:

an axial length of the flame protection cone amounts to up to three times a diameter of the fuel injector in an area of the valve seat member.

5. The fuel injector as recited in claim 3, wherein:

a radial diameter of the flame protection cone amounts to up to one half a diameter of the fuel injector in an area of the valve seat member.

6. The fuel injector as recited in claim 1, wherein:

the flame protection cone includes one of a multi-stage cone and a truncated cone.

7. The fuel injector as recited in claim 6, wherein:

a number of stages of the one of the multi-stage cone and the truncated cone is two.

8. The fuel injector as recited in claim 6, wherein:

a first area extending in the downstream direction from the valve seat member expands radially in the downstream direction.

9. The fuel injector as recited in claim 8, wherein:

an axial length of the first area amounts to up to three times a diameter of the fuel injector in an area of the valve seat member.

* * * * *

UNITED STATES PATENT AND TRADEMARK OFFICE

CERTIFICATE OF CORRECTION

PATENT NO. : 7,021,564 B2
APPLICATION NO. : 10/415544
DATED : April 4, 2006
INVENTOR(S) : Juergen Raimann It is certified that error appears in the above-identified patent and that said Letters Patent is hereby corrected as shown below:

On The Title Page, Item (57) Abstract, lines 1, 3, 4, 5, 6, 7, 8 and 9, delete

"(1)", "(10)", "(3)", "(10)", "(4)", "(6)", "(5)", "(7)", "(6)", "(34)", "(35)" and "(1)".

Signed and Sealed this

Thirtieth Day of October, 2007

JON W. DUDAS
*Director of the United States Patent and Trademark Office*